US011525612B2

(12) United States Patent
Sørensen

(10) Patent No.: US 11,525,612 B2
(45) Date of Patent: Dec. 13, 2022

(54) METHOD FOR REFRIGERANT CHARGE DETERMINATION IN A COOLING CIRCUIT

(71) Applicant: BITZER Electronics A/S, Sønderborg (DK)

(72) Inventor: Kresten Kjaer Sørensen, Augustenborg (DK)

(73) Assignee: BITZER Electronics A/S, Sonderborg (DK)

( * ) Notice: Subject to any disclaimer, the term of this patent is extended or adjusted under 35 U.S.C. 154(b) by 48 days.

(21) Appl. No.: 16/879,465

(22) Filed: May 20, 2020

(65) Prior Publication Data

US 2020/0278140 A1 Sep. 3, 2020

Related U.S. Application Data

(63) Continuation of application No. PCT/EP2017/079920, filed on Nov. 21, 2017.

(51) Int. Cl.
*F25B 49/02* (2006.01)

(52) U.S. Cl.
CPC ..... *F25B 49/02* (2013.01); *F25B 2400/19* (2013.01); *F25B 2500/19* (2013.01); *F25B 2500/222* (2013.01)

(58) Field of Classification Search
CPC ..... F25B 2400/19; F25B 2500/19; F25B 2500/222; F25B 49/02
See application file for complete search history.

(56) References Cited

U.S. PATENT DOCUMENTS 6,196,007 B1 * 3/2001 Schlosser ..... F25C 5/10 62/352
10,808,977 B2 * 10/2020 Schoonen ..... F25B 49/027
(Continued)

FOREIGN PATENT DOCUMENTS

DE 2 257 749 * 2/2009
EP 2257749 A2 12/2010
(Continued)

*Primary Examiner* — Henry T Crenshaw
(74) *Attorney, Agent, or Firm* — Reinhart Boerner Van Deuren P.C.

(57) ABSTRACT

A method for refrigerant charge determination in a cooling circuit including a low-pressure section and a high-pressure section. At least one compressor unit generates a compression flow of refrigerant from said low-pressure section to said high-pressure section. At least one expansion device generates an expansion flow of refrigerant from said high-pressure section to said low-pressure section. A heat-releasing heat exchanger in said high-pressure section cools and condenses compressed refrigerant. A heat-absorbing heat exchanger in said low-pressure section vaporizes said expanded refrigerant. The method includes loading refrigerant from said low-pressure section into said high-pressure section. An unloading step admits the expansion flow of refrigerant loaded in said high-pressure section into said low pressure section and determines the amount of refrigerant flowing in said unloading step. The method includes calculating the refrigerant charge in said cooling circuit, based on the amount of refrigerant flowing from said high-pressure section to said low-pressure section.

31 Claims, 6 Drawing Sheets

(56) References Cited

U.S. PATENT DOCUMENTS

| | | | | |
|---|---|---|---|---|
| 2006/0021362 | A1* | 2/2006 | Sadegh | F25B 49/005 62/149 |
| 2006/0144059 | A1* | 7/2006 | Kang | F25B 49/005 62/208 |
| 2011/0259968 | A1* | 10/2011 | Kumakura | B23P 11/005 29/505 |
| 2015/0219376 | A1* | 8/2015 | Douglas | F25B 49/02 62/126 |
| 2019/0032982 | A1* | 1/2019 | Schoonen | F25B 49/027 |
| 2019/0041109 | A1* | 2/2019 | Schoonen | F25B 49/022 |
| 2019/0362036 | A1* | 11/2019 | Zhang | G06F 30/20 |
| 2020/0278140 | A1* | 9/2020 | Sørensen | F25B 49/02 |

FOREIGN PATENT DOCUMENTS

| | | | |
|---|---|---|---|
| EP | 3252402 | A1 | 12/2017 |
| WO | WO 2016/121714 | A1 | 1/2016 |
| WO | WO 2017/133774 | A1 | 2/2016 |

* cited by examiner

METHOD FOR REFRIGERANT CHARGE DETERMINATION IN A COOLING CIRCUIT

CROSS-REFERENCE TO RELATED PATENT APPLICATION

This application is a continuation of International application number PCT/EP2017/079920 filed on Nov. 21, 2017.

This patent application claims the benefit of International application No. PCT/EP2017/079920 of Nov. 21, 2017, the teachings and disclosure of which are hereby incorporated in their entirety by reference thereto.

BACKGROUND OF THE INVENTION

The invention relates to a method for refrigerant charge determination in a cooling circuit, said cooling circuit comprising: a low pressure section and a high pressure section, a compressor unit for generating compression flow of refrigerant from said low pressure section to said high pressure section by compressing said refrigerant, an expansion device for generating an expansion flow of refrigerant from said high pressure section to said low pressure section by expanding refrigerant present in said high pressure section, a heat releasing heat exchanger in said high pressure section for cooling, in particular condensing, compressed refrigerant, a heat absorbing heat exchanger in said low pressure section for vaporizing said expanded refrigerant.

The term "refrigerant charge" in a cooling circuit according to the present invention has to be understood as the total amount of refrigerant present in said cooling circuit.

Usually determination of the refrigerant charge in a cooling circuit requires a technician to pump down the cooling circuit using a vacuum pump and to measure the amount of evacuated refrigerant with a scale.

This known method makes it necessary to bring the cooling circuit and the storage unit associated therewith as well as the equipment for evacuating the cooling circuit to the same location and to determine the amount of evacuated refrigerant in addition the known method is time consuming so that in summary the known method is quite expensive.

It is the object of the present invention to present a method enabling the determination of the refrigerant charge in a cooling circuit in a less expensive manner.

SUMMARY OF THE INVENTION

This object is resolved by a first embodiment of a method for refrigerant charge determination in a cooling circuit, as explained above which comprises the following steps:

a loading step comprising loading essentially all refrigerant from said low pressure section into said high pressure section by reducing said expansion flow, in particular with the expansion flow being terminated, an unloading step comprising admitting the expansion flow of the refrigerant loaded in said high pressure section into said low pressure section and determining the amount of refrigerant flowing in said unloading step from said high pressure section to said low pressure section, and calculating on the basis of said amount of refrigerant flowing in said unloading step from said high pressure section to said low pressure section the refrigerant charge in said cooling circuit.

The advantage of the present invention is that no additional equipment is necessary for the refrigerant charge determination so that said method can be used in any place without additional equipment.

Further said method is less time consuming so that the object or cargo to be cooled by said cooling circuit is not affected by any temperature change due to said refrigerant charge determination.

The determination of the amount of refrigerant flowing through said expansion device in the course of the unloading step can take place at any degree of opening of said expansion device, as long as the degree of opening is related to defined flow characteristics.

In order to expedite the determination of the amount of refrigerant flowing through said expansion device in the course of said unloading step said expansion device is controlled to be in its fully open state.

In general it would be possible to use the method according to the inventive concept irrespective of the gas phase or liquid phase in which the refrigerant charge is present after the loading step.

In this case for example a flow meter, in particular a Coriolis flow meter, would be used in order to detect the amount of refrigerant flowing from that high pressure section to said low pressure section during said unloading step.

For obtaining accurate results it is of advantage if a termination step, comprising termination of said compression flow is succeeding said loading step so that the system can come into an equilibrium state.

Preferably during said unloading step said compression flow remains terminated in order to avoid inaccuracies of the determination of the amount of refrigerant flowing to said low pressure section.

However it would be possible to allow a reduced compression flow, for example less than 50 percent of the maximum compression flow during said unloading step if the compressed refrigerant does not condense to liquid refrigerant in the heat releasing heat exchanger and therefore reduce the accuracy of the determination of the amount of refrigerant.

However, for performing the method according to the present invention it is of particular advantage if said refrigerant loaded in said high pressure section is condensed to liquid refrigerant by said heat exchanger in said high pressure section at a temperature which is below the maximum saturated discharge temperature, for example 5 kelvin, preferably 10 kelvin below the maximum saturated discharge temperature, because in such a case it can be ascertained that a major portion of the refrigerant passing through said expansion device in said unloading step is liquid.

In order to collect the liquid refrigerant in said high pressure section it is of advantage if said condensed refrigerant in said high pressure section is collected in a receiver for liquid refrigerant which receiver is arranged following said heat releasing heat exchanger.

In order to improve the accuracy of the method according to the invention an advantageous step provides that in the loading step the pressure in the low pressure section is reduced to a pressure at which essentially all liquid refrigerant is evaporated, for example below 100.000 Pa, preferably to below 50.000 Pa, so that in the loading step essentially all refrigerant is loaded into said high pressure section.

In order to be able to control said loading step it is of advantage if during said loading step said expansion flow is maintained until the pressure in said low pressure section reaches a pressure below 50.000 Pa and that the expansion flow is terminated if for example said pressure in said low pressure section is below 20.000 Pa, preferably below 10.000 Pa.

In order to obtain a pressure equilibrium all over the low pressure section it is of advantage not to reduce the pressure in said low pressure section too fast. Therefore it is provided that during said loading step said pressure in said low pressure section is reduced at a rate lower than 2500 Pa per second.

According to the method outlined before it would be possible to immediately switch from the loading step to the termination step and then to the unloading step.

However, an advantageous solution provides that a pressure equalizing step is preceding said unloading step and that during said pressure equalization step said compression flow and said expansion flow stay terminated so that the refrigerant and the components in the low pressure section and in the high pressure section have the chance to equalize the respective pressure and temperature and that the cooling circuit is in steady state conditions.

Said pressure equalization step preferably lasts at least 5 seconds.

In general it is possible to detect in said unloading step the flow of refrigerant from the high pressure section to the low pressure section irrespective of the phase of the refrigerant, e.g. irrespective of the fact whether the refrigerant is present in the liquid or gaseous phase.

In order to enable a fast and effective measurement of the amount of refrigerant flowing in said unloading step from said high pressure section to said low pressure section the determination of the amount of refrigerant comprises the determination of the amount of liquid refrigerant flowing from said high pressure section to said low pressure section.

It is of particular advantage if in the course of said unloading step only the amount of liquid refrigerant is determined so that the time necessary for determining the flow of refrigerant through said expansion device can be kept short.

There are various methods to detect the amount of liquid refrigerant flowing in said unloading step from said high pressure section to said low pressure section.

It is of particular advantage, if the determination of said amount of liquid refrigerant in said unloading step comprises the detection of the time period within which liquid refrigerant is present in said expansion flow.

In order to be certain that during the measurement of the amount of liquid refrigerant there is no flash gas comprised by said expansion flow it is provided that the expansion device is connected to the liquid reservoir in the receiver and when starting the unloading step the expansion flow during a first time period is a flow of essentially only liquid refrigerant. Said first time period comprises the entire time period during which essentially only liquid refrigerant flows through said expansion device.

There are several possibilities to calculate the amount of liquid refrigerant passing through said expansion device during said first time period.

One method provides that the amount of liquid refrigerant passing through said expansion device in said first time period is determined in consideration of the pressure in the high pressure section, the flow characteristics, in particular the geometry data, of the expansion device and the first time period.

An improved version said method considers in addition to the pressure in the high pressure section the pressure in the low pressure section, so that the pressure difference between the two pressures can be used for calculation of the amount of refrigerant.

According to this method the known flow characteristics, in particular the known geometry data of the expansion device, in connection with the pressure in the high pressure section or the pressure difference over the expansion device enable a calculation of the amount of liquid refrigerant flowing through said expansion device per time so that when further considering the first time period the amount of liquid refrigerant flowing through said expansion device during said unloading step can be calculated.

Alternatively it is also possible to determine the amount of liquid refrigerant flowing through said expansion device during said unloading step by determining in advance in the amount of liquid flowing per time at certain pressure levels or pressure difference levels by a calibration process for said expansion device.

Said known relationship between said amount of liquid refrigerant in the expansion flow during said first time period and said refrigerant charge for example can be determined experimentally in advance.

Due to the fact that during said unloading step the pressure at the high pressure section and the pressure at the low pressure section are continuously changing it is of particular advantage if the amount of liquid refrigerant passing through said expansion device in said first time period is determined by considering the pressure at the high pressure section or the pressure difference and the flow characteristics of the expansion device within a plurality of subsequent time intervals and determining the corresponding individual amounts of liquid refrigerant in each individual interval and summing up said individual amounts to said amount of liquid refrigerant.

According to one particular advantageous method of the present invention it is possible to determine the refrigerant charge in said cooling circuit by consideration of a known relationship between said amount of liquid refrigerant in the expansion flow during said first time period and said refrigerant charge.

In connection with the explanations of the various embodiments of the method according to the invention it has not been defined how said first time period shall be determined.

For example it would be possible to incorporate a sensor into the flow line to the expansion device to detect whether liquid refrigerant or gaseous refrigerant is flowing in said flow line.

Such a sensor could be for example a mass flow sensor, for example dependent drag from the flow, in particular a level meter or scale on the high pressure section can be added.

An alternative could be a temperature sensor just after the expansion valve, which will detect a temperature rise when the flow changes from liquid to vapor.

Another advantageous embodiment of the method according to the present invention provides that said first time period is determined by detection of the decrease of the pressure in the high pressure section or the pressure difference between the low pressure section and the high pressure section over the time.

This method is based on the fact that the decrease of the pressure in the high pressure section or the pressure difference between the low pressure section and the high pressure section is depending on the fact whether liquid refrigerant or gaseous refrigerant is flowing through said expansion device.

Therefore it is possible to use the decrease of the pressure in the high pressure section or the pressure difference between the low pressure section and the high pressure section for determining the time at which the flow through the expansion device changes from a flow of liquid refrigerant to a flow of gaseous refrigerant.

One possibility is therefore to analyze the pressure gradient at the high pressure section, which will change significantly when the flow of liquid refrigerant changes to a flow of gaseous refrigerant.

For example it is possible to determine the gradient of the pressure difference over the time is analyzed and the moment of change from the gradient associated with the flow of liquid refrigerant to the gradient associated with the flow of gaseous refrigerant is identified to represent the end of the first time period.

The advantage of this method is to be seen in the fact that there are no additional sensors necessary in order to identify the end of the first time period which starts at the beginning of the unloading step.

As an alternative to the first embodiment of a method according to the present invention the aforementioned object is resolved by a method for refrigerant charge determination in a cooling circuit, said cooling circuit comprising a low pressure section and a high pressure section, at least one compressor unit for generating a compression flow of refrigerant from said low pressure section to said high pressure section by compressing said refrigerant, at least one expansion device for generating an expansion flow of refrigerant from said high pressure section to said low pressure section by expanding refrigerant present in said high pressure section, a heat releasing heat exchanger in said high pressure section for cooling, in particular condensing, compressed refrigerant, a heat absorbing heat exchanger in said low pressure section for vaporizing said expanded refrigerant which method comprises the following steps:

A pressure equalizing step admitting the expansion flow of refrigerant into said low pressure section, a termination step terminating said expansion flow, in particular with the compression flow being terminated.

An evacuating step using the compressor unit to generate said compression flow for pumping essentially all refrigerant from said low pressure section into said high pressure section and determining the total amount of refrigerant transferred during said evacuation step from said low pressure section to said high pressure section, and calculating on the basis of said amount of refrigerant transferred during said evacuation step from said low pressure section to said high pressure section the refrigerant charge in said cooling circuit.

The advantage of the present invention is that no additional equipment is necessary for the refrigerant charge determination, so that said method can be used in any place without additional equipment.

Further said method is less time consuming so that the object or cargo to be cooled by said cooling circuit is not affected by any temperature change due to said refrigerant charge determination.

In particular it is of advantage if in said evacuating step the pressure in the low pressure section is reduced to below 20.000 Pa, preferably to below 10.000 Pa.

In particular, during said evacuating step said expansion flow is terminated at a defined pressure in said low pressure section, in particular a pressure at or below 20.000 Pa, preferably 10.000 Pa.

Such a pressure level insures that essentially all refrigerant is transferred from said low pressure section to said high pressure section.

In order to obtain consistent and accurate results it is required that the preconditions before the measurement begins are consistent and controlled.

In order to achieve defined preconditions a loading step comprising loading essentially all refrigerant from said low pressure section into said high pressure section by reducing said expansion flow and an unloading step admitting the expansion flow of the refrigerant loaded in said high pressure section in said low pressure section are preceding said termination step.

In order to determine the refrigerant charge in said cooling circuit the amount of refrigerant transferred from said low pressure section to said high pressure section is determined by detecting at least the pressure in said low pressure section and considering in addition to said pressure at least the rotational speed of the at least one compressor and the internal cylinder volume of said at least one compressor.

With these parameters it is possible to calculate the amount of refrigerant transferred by said compressor during said evacuation step with the necessary precision.

In particular it is of advantage if in the evacuation step the amount of refrigerant is determined by detecting and considering the pressure in said high pressure section in addition, so that for example the pressure difference between said high pressure section and said low pressure section can be calculated and used for calculating said amount of refrigerant.

Due to the fact that the pressure in the low pressure section and the high pressure section is changing during the transfer of the refrigerant from said low pressure section to said high pressure section the amount of refrigerant transferred to said high pressure section is determined by detecting the pressure in said low pressure section and considering in addition to said pressure at least the rotational speed of the compressor and the internal cylinder volume within a plurality of subsequent individual time intervals and determining the corresponding individual amounts of refrigerant in each interval and summing up said individual amounts to said amount of refrigerant transferred.

In order to the refrigerant charge in said cooling circuit a known relationship, for example determined experimentally, between said amount of refrigerant transferred during said evacuation step and said refrigerant charge is considered.

In principle the loading step could be started from any mode of operation of the cooling circuit.

However, in order to properly prepare the cooling circuit for said loading step it is of advantage if a pre-cooling step is preceding said loading step.

Such a pre-cooling step has the advantage that the refrigerant and the components in the high pressure section can be pre-cooled in order to avoid generation of flash gas in said high pressure section.

Preferably, in the pre-cooling step the cooling circuit is run at the lowest possible pressure in the high pressure section which enables to reduce the temperature of the refrigerant in said high pressure section and also to reduce the temperature of the components in said high pressure section to the lowest possible temperature.

In order to further suppress the formation of flash gas in said high pressure section it is of advantage if a pressure increasing step is preceding the loading step and in particular succeeding the pre-cooling step.

This pressure increasing step enables further subcooling of the refrigerant in said high pressure section.

For example in the pressure increasing step the pressure is increased to a pressure corresponding to a temperature change of at least 10 Kelvin.

In particular in the pressure increasing step the pressure in the high pressure section is increased to a pressure below the maximum allowed pressure in said high pressure section and above 90%, even better above 95%, of the maximum allowed pressure.

This pressure increasing step ensures that the pressure does not drop below the pressure corresponding to the temperature for liquid refrigerant during the unloading step.

In addition to the various embodiments of the methods outlined before the invention also refers to a cooling circuit comprising a low pressure section and a high pressure section, a compressor unit arranged between said low pressure section and said high pressure section for generating a compression flow of refrigerant from said low pressure section to said high pressure section by compressing refrigerant, an expansion device for generating an expansion flow of refrigerant from said high pressure section to said low pressure section by expanding refrigerant present in said high pressure section, a heat releasing heat exchanger arranged in said high pressure section cooling said compressed refrigerant, a heat absorbing heat exchanger in said low pressure section vaporizing said expanded refrigerant, said cooling circuit comprising a control unit, said control unit being operable in a heat transfer mode in which said control unit controls said cooling circuit in accordance with the amount of heat to be transferred from said heat absorbing heat exchanger in said low pressure section to said heat releasing heat exchanger in said high pressure section and said control being operable in a refrigerant charge determination mode in which said cooling circuit is operated by a method according to the features of one of the preceding methods.

The advantage of the present invention has to be seen in the fact that the control unit which is used to operate the cooling circuit in the heat transfer mode can also be used to operate said cooling circuit in said refrigerant charge determination mode so that no additional hardware is necessary for performing the method according to the present invention.

In order to be able to load the full charge of refrigerant of said cooling circuit in said high pressure section, for example in said loading step, it is of advantage if said high pressure section is designed to store the full charge of refrigerant of said cooling circuit.

Further in order to load the full charge of refrigerant of said cooling circuit in said low pressure section, for example before the evacuating step it is of advantage if said low pressure section is designed to store the full charge of refrigerant of said cooling circuit.

In order to be able to load said refrigerant in said cooling circuit into said high pressure section in said loading step it is of advantage if said cooling circuit in said high pressure section comprises a receiver separating liquid from gaseous refrigerant and a connecting line between said receiver and said expansion device said connecting line being connected to a reservoir of liquid refrigerant in said receiver so that on one hand the cooling circuit provides sufficient volume in said high pressure section for storing said refrigerant of said cooling circuit in said high pressure section at the end of said loading step and on the other hand the presence of the receiver in the high pressure section enables to perform said unloading step by having liquid refrigerant comprised in said expansion flow.

In order to be able to adapt the operation of the cooling circuit to the various operational modes it is of advantage if the compressor unit is capacity controlled, for example by a mechanical capacity control and/or a speed control so that the control unit is able to adjust the operation of the compressor unit to the requirements in said cooling circuit.

Further it is of advantage if the expansion device is controlled by said control unit.

Preferably said expansion device is adapted to be controlled to be in a fully open state, closed state and in particular in intermediate states so that the expansion flow can be adjusted according to the respective requirements for an optimized operation of said cooling circuit.

An advantageous embodiment provides that said expansion device in said unloading step of said charge determination mode is controlled to be in a defined open state, for example in a fully open state, in order to obtain a maximum expansion flow through said expansion device during the unloading step.

It can be of advantage to properly detect the pressure in said low pressure section so that a pressure sensor is arranged in said low pressure section and connected to said control unit.

In order to detect the pressure in said high pressure section the pressure sensor is arranged in said high pressure section and connected to said control unit.

Additional features and advantages of the present invention are subject matter of the following detailed specification and the drawings.

DETAILED DESCRIPTION OF THE INVENTION

Figure 1:
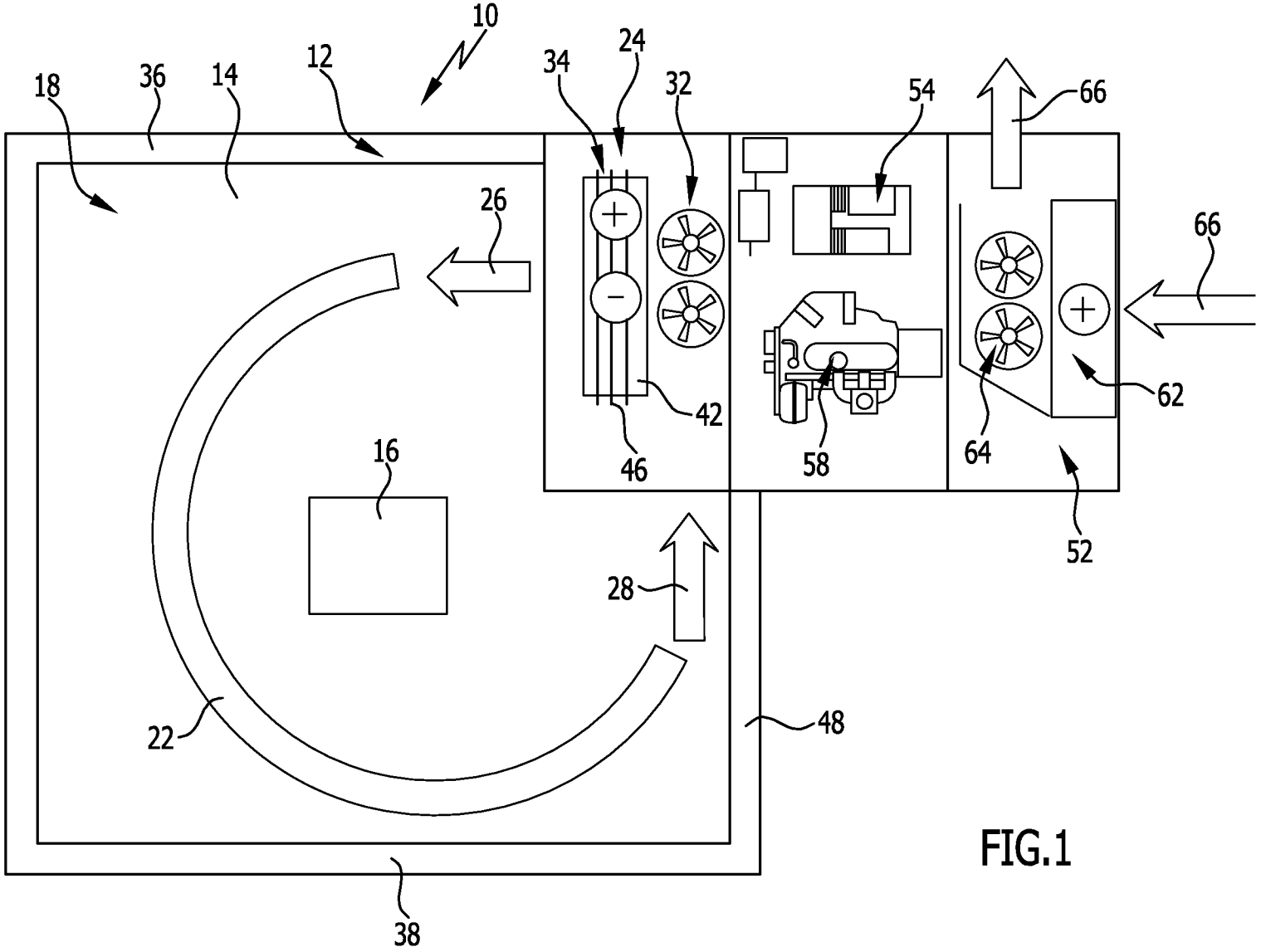
FIG. 1 shows a schematic representation of a storage unit according to the present invention.

The invention is explained for example in connection with a storage unit 10 comprising an insulated housing 12 enclosing a storage volume 14 within which temperature sensitive cargo is received surrounded by a gaseous medium, in particular air, which is kept at a defined temperature level for maintaining said cargo 16 in a defined temperature range.

However the inventive concept can be used in any other environment.

Said storage unit 10 can be for example a storage unit 10 in a supermarket or any other warehouse.

Said storage unit 10 can also be a transportable storage unit, for example of a truck or a trailer or a ship or a railway carriage transporting cargo 16 or a conventional container for shipping cargo 16 by truck, railway or ship.

In order to maintain a defined or set temperature range of cargo 16 a flow 22 of said gaseous medium 18 is circulating through volume 14 starting from a tempering unit 24 as a supply gas flow and entering tempering unit 24 as a return gas flow.

The circulating gas flow 22 is for example generated by a fan unit 32 preferably arranged within tempering unit 24 and tempered by a heat exchange unit 34 arranged within tempering unit 24.

Preferably supply gas flow 26 exits from tempering unit 24 in an area close to an upper wall 36 of insulated container housing 12 and preferably returns to tempering unit 24 close to a lower wall 38 of insulated container housing 12 forming said return gas flow 28.

Figure 2:
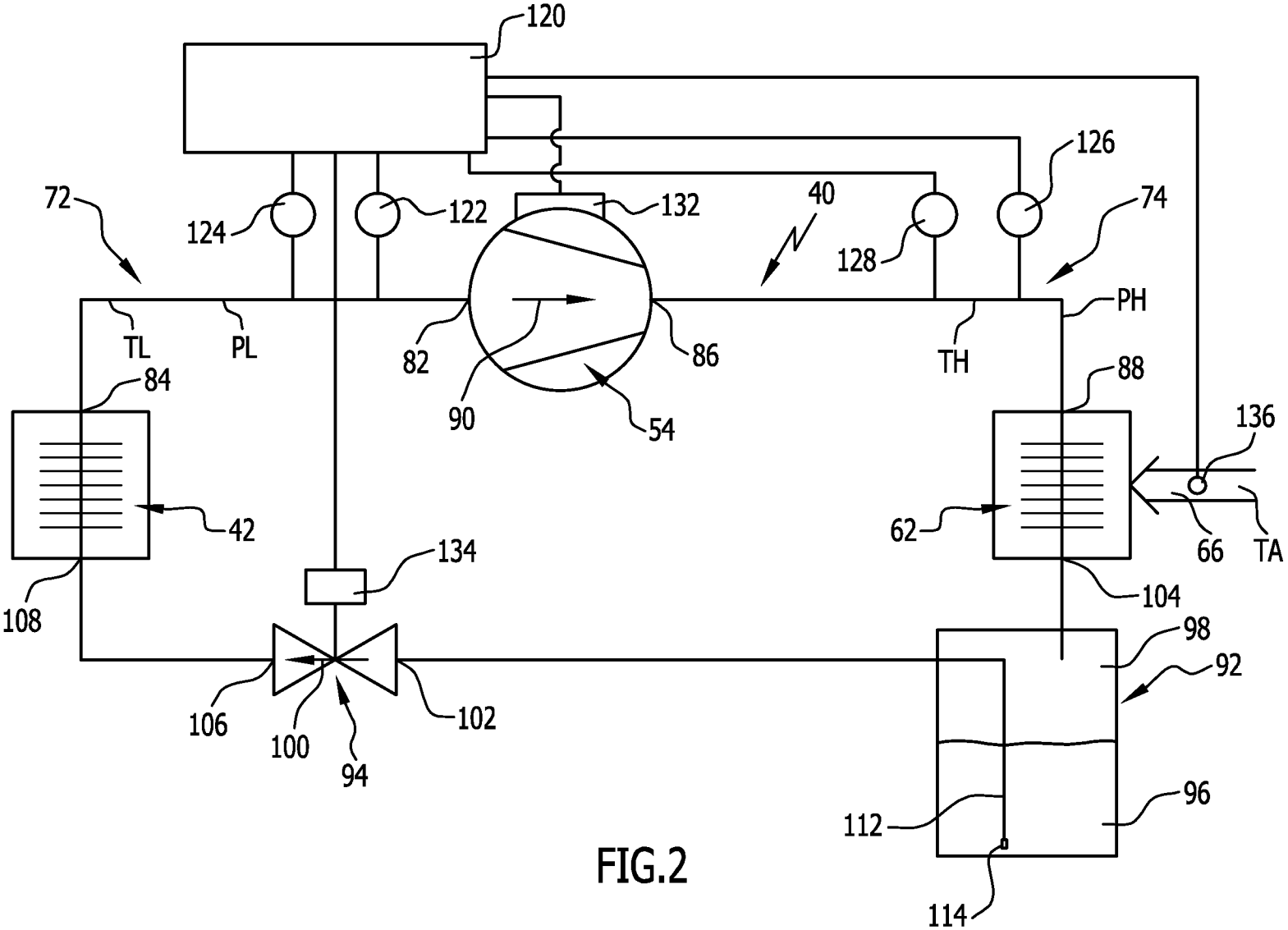
FIG. 2 shows a schematic representation of a cooling circuit according to the present invention.

According to a preferred embodiment heat exchange unit 34 comprises a heat absorbing heat exchanger 42 arranged in a refrigerant circuit 40 as shown in FIG. 2 and in particular further comprises heaters 46 which are for example electric heaters.

Tempering unit 24 is for example arranged close to upper wall 36 of isolated housing 12, in particular on a front wall 48 or a rear wall thereof.

However, tempering unit 24 can also be arranged on upper wall 36 or a lower wall 38.

Tempering unit 24 is associated with peripheric unit 52 which comprises a heat releasing heat exchanger 62 a fan unit 64 for generating a flow of ambient air 66 through heat releasing heat exchanger 62.

In case of a transportable storage unit 10 a compressor unit 54 and a power source 58 are provided and for example integrated in peripheric unit 52.

In case of a stationary unit 10 compressor unit 54 is arranged separate and power is supplied by a mains power network.

Cooling circuit 40, as shown in FIG. 2, comprises a low pressure section 72, in which heat absorbing heat exchanger 42 is arranged and a high pressure section 74, in which heat releasing heat exchanger 62 is arranged, and compressor unit 54 connected with a suction connection 82 to an outlet 84 of heat absorbing heat exchanger 42 and with a discharge connection 86 to an inlet 88 of heat releasing heat exchanger 62, so that compressor unit 54 can generate a compression flow 90 of refrigerant from low pressure section 72 to high pressure section 74.

Further cooling circuit 40 as shown in FIG. 2 comprises an expansion device 94 being connected directly or indirectly to an outlet 104 of heat releasing heat exchanger 62 for example via a receiver 92 for liquid refrigerant and expansion device 94 being connected with its outlet 106 to an inlet 108 of heat absorbing heat exchanger 42.

Receiver 92 is designed to collect liquid refrigerant condensed in heat releasing heat exchanger 62 and supplied through outlet 104 of heat releasing heat exchanger 62 to receiver 92 so that in receiver 92 a reservoir 96 of liquid refrigerant is present and—depending on the pressure relationship—a reservoir 98 of gaseous refrigerant maybe present above reservoir 96 of liquid refrigerant.

Further receiver 92 is provided with a discharge line 112 having a discharge port 114 arranged within receiver 92 such that liquid refrigerant from reservoir 96 is discharged from receiver 92 if present therein.

Receiver 92 is arranged between inlet 102 of expansion device 94 and outlet 104 of heat releasing heat exchanger 62 so that discharge line 112 is connected to inlet 102 of expansion device 94 so that in case of liquid refrigerant is present in reservoir 96 only liquid refrigerant is supplied to expansion device 94.

A control unit 120 associated with cooling circuit 40 is connected to a pressure sensor 122 associated with low pressure section 72 and a temperature sensor 124 associated with low pressure section 72 and also connected to a pressure sensor 126 associated with high pressure section 74 and a temperature sensor 128 associated with high pressure section 74.

Further control unit 120 is connected to a capacity control 132 of compressor unit 54 and to an adjusting means 134 for adjusting expansion device 94.

For example adjusting means 134 is a drive for adjusting expansion device 94 which is for example an expansion valve.

Said cooling circuit is operated by said control unit in a heat transfer mode in which said compressor unit 54 is speed controlled and said expansion device 94 is controlled in accordance with the amount of heat to be transferred from said heat absorbing heat exchanger 42 to said heat releasing heat exchanger 62 depending on the temperature of the flow of ambient air 66, according conventional control procedures.

In order to operate cooling circuit in a refrigerant charge determination mode in accordance with the present invention, it is of advantage that all refrigerant being present in cooling circuit 40 can be stored at least in one of the low pressure section 72 and in high pressure section 74.

Usually heat absorbing heat exchanger 42 in low pressure section 72 is designed with a volume receiving a large amount of vapor so that storing all refrigerant present within cooling circuit 40 in low pressure section is possible.

Depending on the design of heat releasing heat exchanger 62 storing all refrigerant within high pressure section 74 depends on the volume provided within heat releasing heat exchanger 62 or the volume provided by receiver 92 in case a receiver 92 is present in high pressure section 74 and arranged between heat releasing heat exchanger 62 and expansion device 94.

In order to determine the refrigerant charge, e.g. the total amount of refrigerant in cooling circuit 40, it is necessary to detect the ambient temperature present for receiving heat in heat releasing heat exchanger 62 by ambient temperature sensor 136.

Control unit 120 can only start refrigerant charge determination if the ambient temperature TA is low enough in order to be able to cool the refrigerant in heat releasing heat exchanger 62 to a temperature which is several kelvin, for example 5 kelvin or preferably 10 kelvin, below the maximum saturated discharge temperature for the type of refrigerant used in cooling circuit 40.

This ensures that for refrigerant charge determination the formation of flash gas in the high pressure section 74 is avoided.

Before starting the refrigerant charge determination according to the present invention a refrigerant sub cooling step is started.

Figure 3:
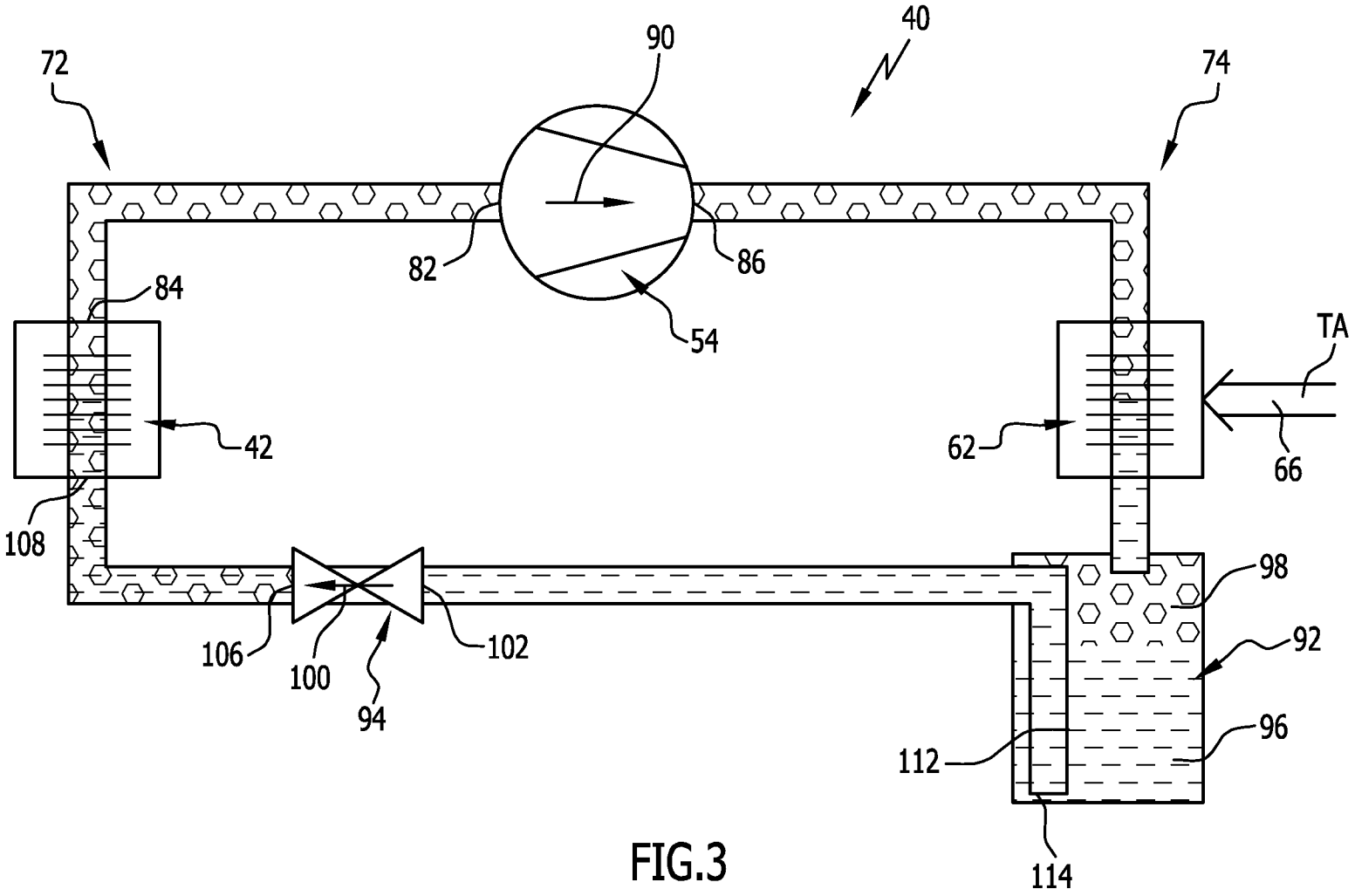
FIG. 3 shows a schematic representation of the cooling circuit in a pre-cooling step.
Figure 4:
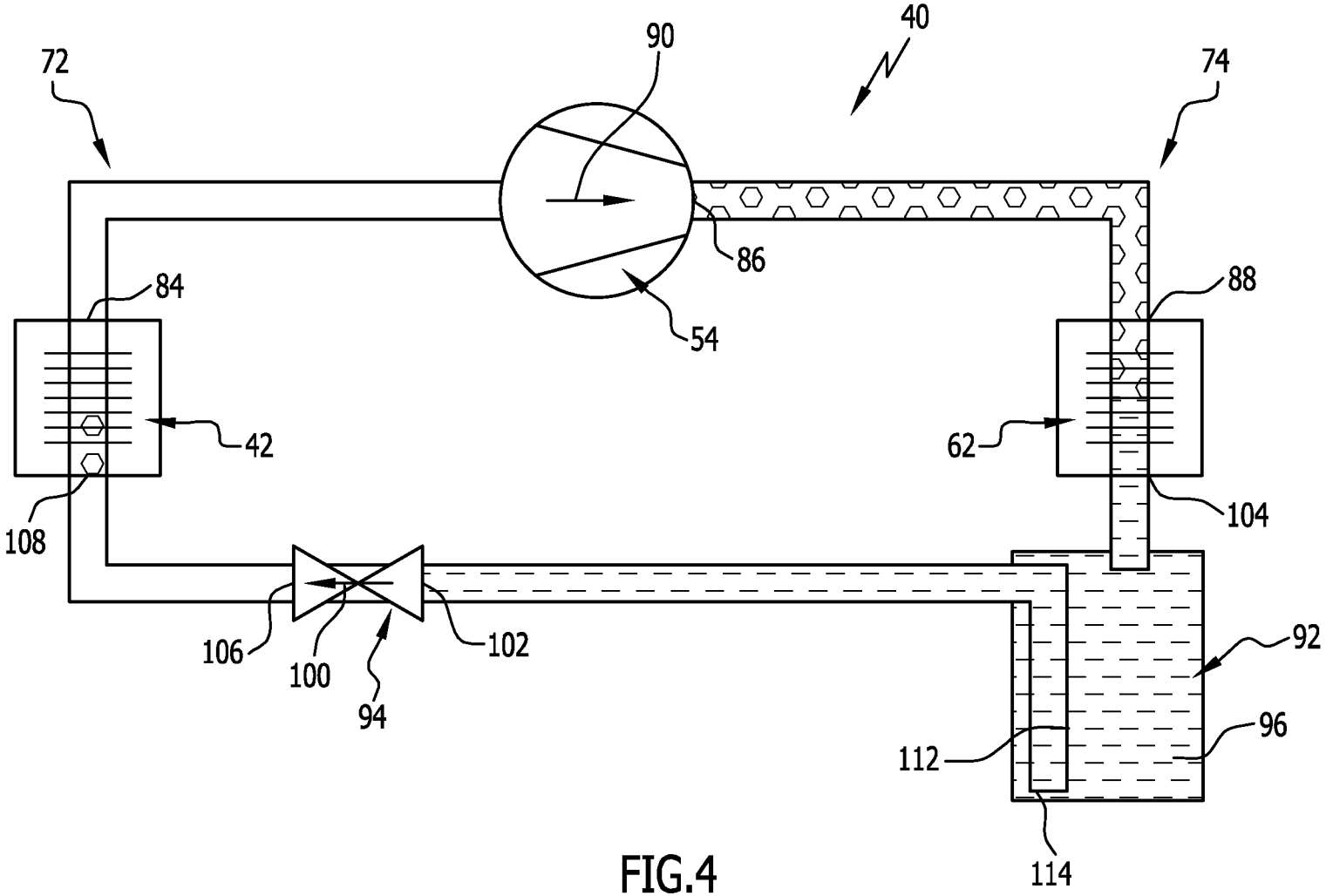
FIG. 4 is a schematic representation of the operation of said cooling circuit in a loading step.

In the subcooling step as illustrated in FIG. 3 cooling circuit 40 is run by control unit 120 at the lowest possible pressure PH in high pressure section 74 in order to reduce the temperature TH of the liquid refrigerant in the reservoir 96 of liquid refrigerant to a temperature which is as low as possible.

In particular, the time period for which control unit 120 runs cooling circuit 40 in the subcooling step is long enough to ensure that the full charge of refrigerant circulates at least once through the cooling circuit 40.

In particular, in the subcooling step fan unit 64 is controlled by control unit 120 to operate at maximum speed and to generate a maximum air flow 66 of ambient air through heat releasing heat exchanger 62.

In addition in the subcooling step control unit 120 operates fan unit 32 associated with heat absorbing heat exchanger 42 at minimum speed or even turns off fan unit 32 in order to reduce the amount of heat absorbed by heat absorbing heat exchanger 42 so that the pressure within low pressure section 72 is kept at the lowest level possible.

In order to increase subcooling of liquid refrigerant in reservoir 96 within high pressure section 74 the subcooling step is followed by a pressure increasing step during which pressure PH in high pressure section 74 is increased by controlling compressor unit 54 and the expansion device 94 in order to increase the pressure PH in high pressure section 94 to the maximum allowed pressure which enables to avoid flash gas in high pressure section 74.

In particular, the pressure in high pressure section 74 can be increased to a pressure corresponding to a temperature change of at least 10 Kelvin or for example to a pressure in a range between 90% to 100% of the maximum allowed operating pressure, but below the maximum allowed temperature.

During pressure increasing step control unit 120 controls fan unit 64 associated with heat releasing heat exchanger 62 to obtain the maximum possible release of heat by heat exchanger 62.

A first embodiment of a method according to the invention provides the following steps:

Subsequent to running cooling circuit 40 in the pressure increasing step control unit 120 runs cooling circuit 40 in a loading step in which compressor unit 54 is controlled to empty low pressure section 72 by reducing the pressure PL therein to a pressure below 100.000 Pa, preferably below 50.000 Pa, absolute pressure.

For finalizing the loading step control unit 120 controls compressor unit 54 and expansion device 94 to essentially evacuate low pressure section 72 to a pressure below 20.000 Pa, preferably a pressure below 10.000 Pa, which ends up finally in a termination step comprising closing expansion device 94 and switching off compressor unit 54.

At the end of the loading step low pressure section 72 is essentially free from refrigerant whereas all refrigerant present in the cooling circuit 40 is stored in high pressure section 74 essentially in its liquefied state so that essentially reservoir 96 fills receiver 92 and liquefied refrigerant might even extend into heat releasing heat exchanger 96.

Preferably, the termination step is succeeded by a pressure stabilizing step in which compressor unit 54 stays shut off and expansion device 94 stays closed so that pressure differences within low pressure section 72 and pressure differences within high pressure section 74 will be equalized and stabilized at the respective levels.

Said termination step lasts at least for 5 seconds.

In a subsequent unloading step compressor unit 54 will stay shut off whereas the expansion device 94 will be opened to a certain level, for example fully opened, by control unit 120 controlling adjusting means 134 and during the unloading step control unit 120 records the pressure PL in low pressure section 72 and the pressure PH in high pressure section 74 in order to determine the pressure difference between the high pressure section 74 and low pressure section 72.

Figure 5:
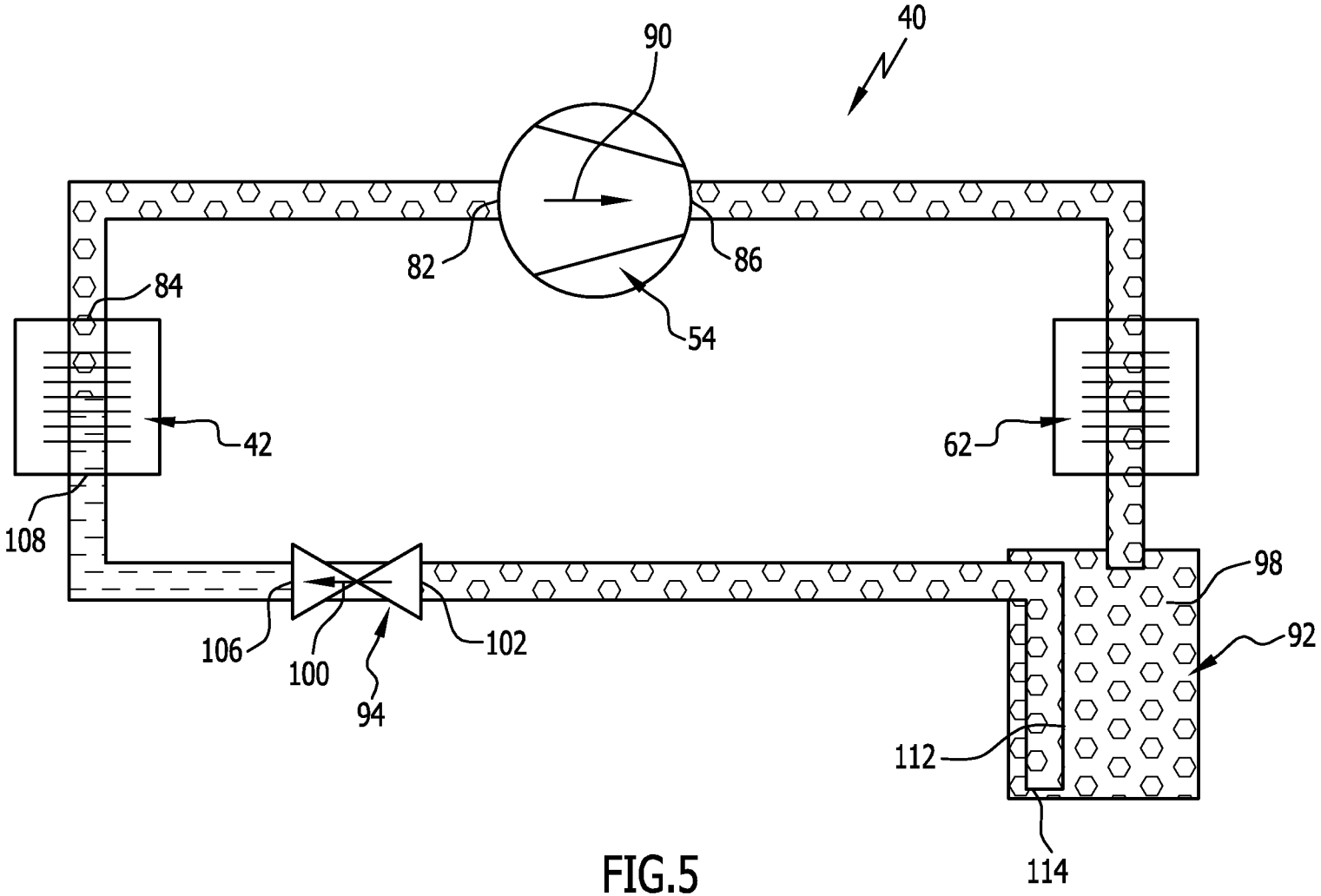
FIG. 5 shows a schematic representation of the cooling circuit according to the present invention at the end of an unloading step and FIG. 6 shows a diagram representing the behavior of the pressure in the high pressure section during said unloading step and the determination of the end of a first time period in which liquid refrigerant flows through said expansion device.

In the course of the unloading step all liquid refrigerant present in high pressure section 74 will flow through expansion device 94 into low pressure section 72 so that at the end of the unloading step, as schematically represented in FIG. 5, all liquid refrigerant will be present in low pressure section 72 whereas in high pressure section 74 and in particular in receiver 92 only gaseous refrigerant will be present.

For example the unloading step can be terminated after a period of about 70 seconds or for example after achieving a pressure difference between the low pressure section 72 and the high pressure section of less than 100.000 Pa corresponding to a difference between the saturated temperature in the high pressure section 74 and a saturated temperature in the low pressure section 72 of less than 30 K.

Figure 6:
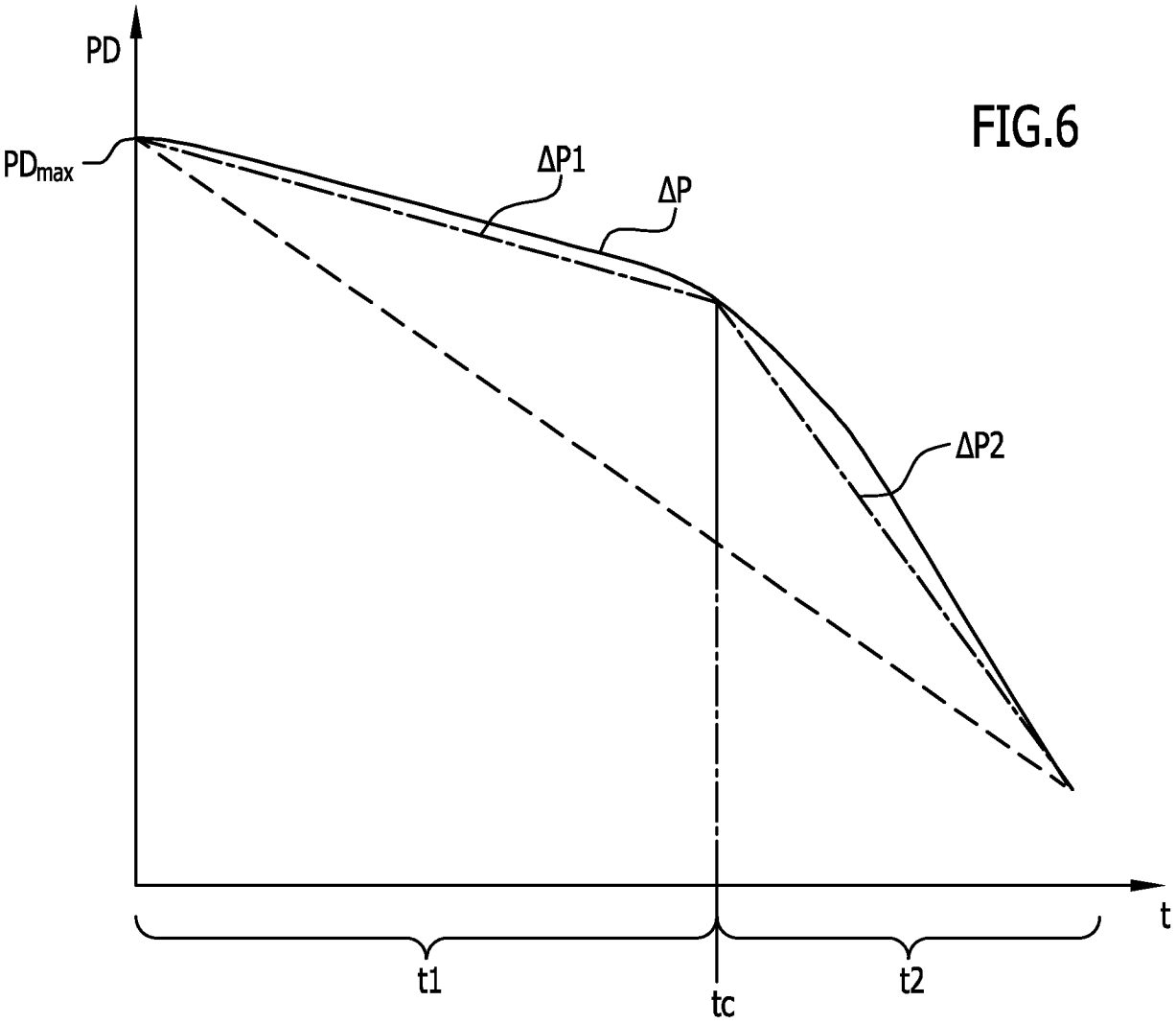

The pressure PH in high pressure section 74 will behave over the time scale as schematically shown in FIG. 6.

There will be during a first time period t1 a gradient λP1 and after the first time period t1 during a time period t2 a pressure drop according to a gradient λP2 which is greater than the gradient λP1.

The different gradients λP1 and λP2 are due to the fact that during the time period t1 only liquid refrigerant will flow through expansion device 94 which liquid refrigerant will be subject to the specific flow geometry within expansion device 94.

If, however all liquid refrigerant in high pressure section 74 has passed through expansion valve 94 and the liquid is followed by gaseous refrigerant the gradient λP2 of the pressure will be steeper starting from the time tc at which the change from a flow of liquid refrigerant to a flow of gaseous refrigerant through expansion device 94 occurs.

The time tc can be easily determined from the overall gradient λP of the pressure difference PD recorded by control unit 120 during the time period t1 and at least in part during the time period t2 so that it is possible to calculate the gradients λP1 and λP2 and to determine from these gradients the time tc at which the change from the flow of liquid refrigerant to the flow of gaseous refrigerant through expansion device 94 occurs.

If in advance based on the flow geometry of the expansion device 94 the flow rate of liquid refrigerant and the flow rate of gaseous refrigerant through expansion device 94 in relation to the pressure PH in the high pressure section 74 or pressure difference PD and the opening degree of expansion device 94 is calculated by a theoretical model it is possible to calculate the amount of flow of liquid refrigerant from high pressure section 74 to low pressure section 72 by determining the time tc and based on the amount of liquid refrigerant a determination of the charge of cooling circuit is possible if it is assumed that the amount of liquid refrigerant flowing through expansion device 94 represents about 90% to 95% of the total charge of refrigerant in cooling circuit 40.

One possibility of simple model for calculation provides:

$$AR = OD \cdot C \sqrt{\frac{2PD}{VS}}$$

AR=amount of refrigerant
OD=opening degree of the expansion device
C=constant value
VS=specific volume of refrigerant
PD=pressure difference A second embodiment of a method according to the invention provides the following steps:

Subsequent to running cooling circuit 40 in the pressure increasing step or said loading step control unit 120 runs cooling circuit 40 in a termination step terminating said compression flow 90 and thereafter in a pressure equalizing step admitting the expansion flow 100 of refrigerant into said low pressure section 72 until the pressure PH in the high pressure section 74 is essentially equal, in particular equal, to the pressure PL in the low pressure section 72.

At the end of the pressure equalizing step it can be assumed that essentially all refrigerant of the refrigerant charge in cooling circuit 40 is located in said low pressure section 72.

After termination of the pressure equalizing step control unit 120 in a termination step terminates said expansion flow 100 by controlling expansion device 94 to be in its closed state.

In the subsequent evacuation step control unit 120 controls compressor unit 54 to generate compression flow 90 for transferring refrigerant from said low pressure section 72 into said high pressure section 74 in order to transfer the total amount of refrigerant from said low pressure section 72 to said high pressure section 74.

The evacuating step is terminated at a defined pressure PL in said low pressure section 72, in particular in case said pressure in said low pressure section 72 is below 20.000 Pa, preferably below 10.000 Pa.

During said evacuation step control unit 120 detects the pressure PL in the low pressure section 72 and also detects the rotational speed of the compressor 54 and by taking into account the internal cylinder volume of said compressor 54 and in particular the pressure PH in the high pressure section 74 control unit 120 calculates the amount of refrigerant transferred from said low pressure section 72 to said high pressure section 74.

Based on an known relationship between said amount of refrigerant transferred during said evacuation step from said low pressure section 72 to said high pressure section 74 and the total refrigerant charge the refrigerant charge of said cooling circuit can be determined based of said amount of refrigerant transferred during said evacuation step.

One possibility of a simple model provides:

$$AR = C1 \cdot PL - C2 \cdot \frac{S}{50}$$

AR=amount of refrigerant
PL=absolute pressure in the low pressure section
S=speed of compressor in rotations per second
C1=constant value 1
C2=constant value 2

The invention claimed is:

1. Method for refrigerant charge determination in a cooling circuit, said cooling circuit comprising:

a low pressure section and a high pressure section, at least one compressor unit for generating compression flow of refrigerant from said low pressure section to said high pressure section by compressing said refrigerant, at least one expansion device for generating an expansion flow of refrigerant from said high pressure section to said low pressure section by expanding refrigerant present in said high pressure section, a heat releasing heat exchanger in said high pressure section for cooling and condensing compressed refrigerant, a heat absorbing heat exchanger in said low pressure section for vaporizing said expanded refrigerant, said method comprising the following steps:

a loading step comprising loading essentially all refrigerant from said low pressure section into said high pressure section by reducing said expansion flow with the expansion flow being terminated, an unloading step admitting the expansion flow of the refrigerant loaded in said high pressure section into said low pressure section and determining the amount of refrigerant flowing in said unloading step from said high pressure section to said low pressure section, and calculating on the basis of said amount of refrigerant flowing in said unloading step from said high pressure section to said low pressure section the refrigerant charge in said cooling circuit.

2. Method according to claim 1, wherein refrigerant loaded in said high pressure section is condensed to liquid refrigerant by said heat exchanger in said high pressure section at a temperature which is below the maximum saturated discharge temperature.

3. Method according to claim 1, wherein said condensed refrigerant in said high pressure section is collected in a receiver for liquid refrigerant.

4. Method according to claim 1, wherein in the loading step pressure in the low pressure section is reduced to below 100,000 Pa.

5. Method according to claim 1, wherein, during said loading step, said expansion flow is terminated at a pressure in said low pressure section below 20,000 Pa.

6. Method according to claim 5, wherein during said loading step said pressure in said low pressure section is reduced at a rate lower than 2500 Pa/sec.

7. Method according to claim 5, wherein a pressure equalizing step precedes said unloading step and wherein, during said equalizing step, said compression flow and said expansion flow stay terminated.

8. Method according to claim 1, wherein the determination of the amount of refrigerant in the course of said unloading step comprises the determination of the amount of liquid refrigerant in said expansion flow.

9. Method according to claim 8, wherein in the course of said unloading step only the amount of liquid refrigerant is determined.

10. Method according to claim 8, wherein said determination of said amount of liquid refrigerant in said unloading step comprises detection of a first time period within which liquid refrigerant is present in said expansion flow.

11. Method according to claim 10, wherein the expansion device is connected to a liquid reservoir in the receiver and, when starting the unloading step, the expansion flow during the first time period is a flow of essentially only liquid refrigerant.

12. Method according to claim 8, wherein the amount of liquid refrigerant passing through said expansion device in said first time period is determined in consideration of the pressure in the high pressure section the flow characteristics, the known geometry data of the expansion device, and the first time period.

13. Method according to claim 10, wherein the amount of liquid refrigerant flowing per time through said expansion device at certain pressure level or at pressure difference levels is determined in advance by a calibration process for said expansion device.

14. Method according to claim 13, wherein the amount of liquid refrigerant passing through said expansion device in said first time period is determined by considering the pressure at the high pressure section and the flow characteristics of the expansion device within a plurality of subsequent time intervals and determining the corresponding individual amounts of liquid refrigerant in each individual interval and summing up said individual amounts to said amount of liquid refrigerant.

15. Method according to claim 10, wherein the determination of the refrigerant charge in said cooling circuit comprises the consideration of a known relationship between said amount of liquid refrigerant in the expansion flow during said first time period and said refrigerant charge.

16. Method according to claim 11, wherein said first time period is determined by detection of the decrease of the pressure in the high pressure section or a pressure difference between the low pressure section and the high pressure section over the time.

17. Method according to claim 16, wherein a gradient of the pressure in the high pressure section or the pressure difference over the time is analyzed and the moment of change from the gradient associated with the flow of liquid refrigerant to the gradient associated with the flow of gaseous refrigerant is identified to represent the end of the first time period.

18. Method for refrigerant charge determination in a cooling circuit, said cooling circuit comprising:

a low pressure section and a high pressure section, at least one compressor unit for generating a compression flow of refrigerant from said low pressure section to said high pressure section by compressing said refrigerant, at least one expansion device for generating an expansion flow of refrigerant from said high pressure section to said low pressure section by expanding refrigerant present in said high pressure section, a heat releasing heat exchanger in said high pressure section for cooling and condensing compressed refrigerant, a heat absorbing heat exchanger in said low pressure section for vaporizing said expanded refrigerant, said method comprising the following steps:

a pressure equalizing step admitting the expansion flow of refrigerant into said low pressure section with the compression flow being terminated, a termination step, terminating said expansion flow, an evacuating step using the compressor unit to generate said compression flow for pumping essentially all refrigerant from said low pressure section into said high pressure section and determining the total amount of refrigerant transferred during said evacuation step from said low pressure section to said high pressure section and calculating on the basis of said amount of refrigerant transferred during said evacuation step from said low pressure section to said high pressure section the refrigerant charge in said cooling circuit.

19. Method according to claim 18, wherein in the evacuating step the pressure in the low pressure section is reduced to below 20,000 Pa.

20. Method according to claim 18, wherein, during said evacuating step, said expansion flow is terminated at a defined pressure in said low pressure section, the defined pressure being below 20,000 Pa.

21. Method according to claim 18, wherein a loading step comprising loading essentially all refrigerant from said low pressure section into said high pressure section by reducing said expansion flow, and an unloading step admitting the expansion flow of the refrigerant loaded in said high pressure section into said low pressure section are preceding said termination step.

22. Method according to claim 18, wherein, in the evacuation step, the amount of refrigerant transferred to said high pressure section is determined by detecting at least a pressure in said low pressure section and considering, in addition to said pressure, at least a rotational speed of the at least one, and an internal cylinder volume of said at least one compressor.

23. Method according to claim 22, wherein, in the evacuation step, the amount of refrigerant is determined by detecting and considering a pressure in said high pressure section.

24. Method according to claim 22, wherein the amount of refrigerant transferred to said high pressure section is determined by detecting the pressure in said low pressure section and considering in addition to said pressure at least the rotational speed of the compressor and the internal cylinder volume within a plurality of subsequent individual time intervals and determining the corresponding individual amounts of refrigerant in each individual interval and summing up said individual amounts to said amount of refrigerant transferred.

25. Method according to claim 18, wherein the determination of the refrigerant charge in said cooling circuit comprises the consideration of a known relationship between said amount of refrigerant transferred during said evacuation step and said refrigerant charge.

26. Method according to claim 1, wherein a pre-cooling step precedes the loading step.

27. Method according to claim 26, wherein in the pre-cooling step the cooling circuit is run at the lowest possible pressure in the high pressure section.

28. Method according to claim 26, wherein a pressure increasing step precedes the loading step and succeeds the pre-cooling step.

29. Method according to claim 28, wherein, in the pressure increasing step, the pressure in the high pressure section is increased to a pressure below a maximum allowed pressure and above 90% of the maximum allowed pressure.

30. Method according to claim 1, wherein in the loading step pressure in the low pressure section is reduced to below 50,000 Pa.

31. Method according to claim 18, wherein, in the evacuating step, the pressure in the low pressure section is reduced to below 10,000 Pa.

* * * * *